US005267404A

United States Patent [19]

Kizy

[11] Patent Number: 5,267,404

[45] Date of Patent: Dec. 7, 1993

[54] DISPLAY

[76] Inventor: John J. Kizy, 29460 Woodhaven, Southfield, Mich. 48075

[21] Appl. No.: 964,588

[22] Filed: Oct. 21, 1992

[51] Int. Cl.[5] ..... G09F 13/26

[52] U.S. Cl. ..... 40/545; 40/564

[58] Field of Search ..... 40/545, 564, 568, 575

[56] References Cited

U.S. PATENT DOCUMENTS

| | | | |
|---|---|---|---|
| 1,854,654 | 4/1932 | Koch, Jr. | 40/545 |
| 1,858,643 | 5/1932 | Schouwstra | 40/545 |
| 1,939,288 | 12/1933 | Allison | 40/545 |
| 2,225,961 | 12/1940 | Rundberg | 40/564 |
| 3,965,597 | 6/1976 | Noellert | 40/545 |
| 4,035,632 | 7/1977 | Rayman | 40/545 |
| 4,848,017 | 7/1989 | Bailey et al. | 40/564 X |
| 4,951,405 | 8/1990 | Sabala | 40/545 X |
| 4,969,282 | 11/1990 | Eberhart | 40/545 |

FOREIGN PATENT DOCUMENTS

| | | | |
|---|---|---|---|
| 24027 | 8/1936 | Australia | 40/545 |

*Primary Examiner*—Kenneth J. Dorner
*Assistant Examiner*—J. Bonifanti
*Attorney, Agent, or Firm*—Dykema Gossett

[57] ABSTRACT

A display assembly 10 is adapted to selectively illuminate those numerals associated with a home address. Moreover, display 10 includes a mounting member 12 which is adapted to be mounted to the surface of the house and a flat plate 26 which is adapted to overlay the mounting member 12 and which further is adapted to receivably mount neon tubes 30 which are selectively illuminated and which are configured in a shape which is substantially similar to numerals associated with a home address.

4 Claims, 1 Drawing Sheet

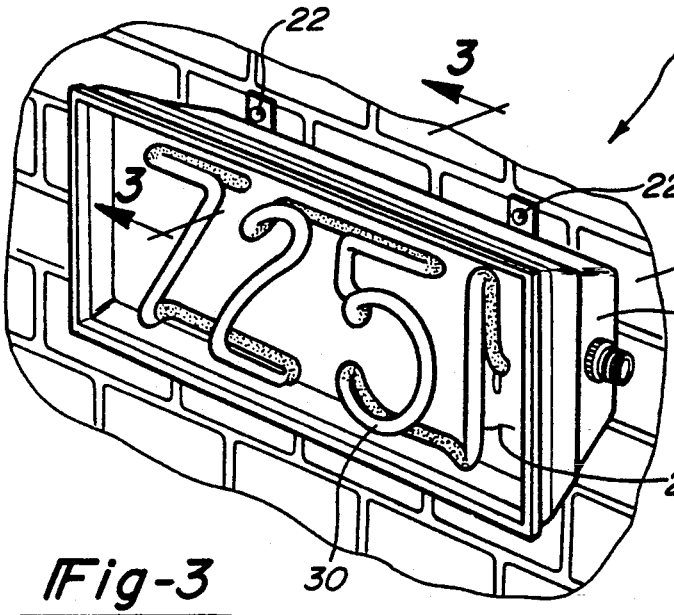
Fig-1
Fig-3
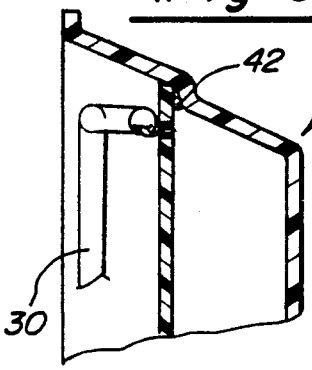
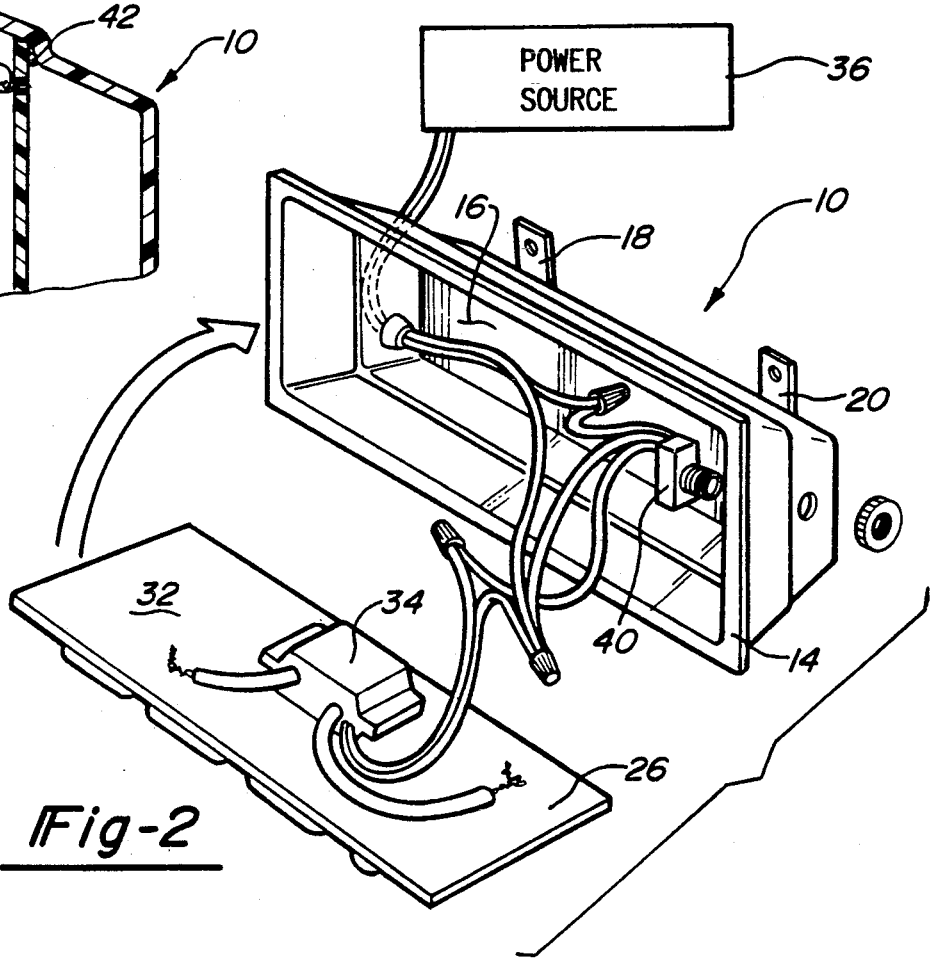
Fig-2

DISPLAY

BACKGROUND OF THE INVENTION

1. Field of the Invention

This invention relates to a display, and more particularly, to a display which is adapted to be mounted upon a house and which is further adapted to selectively illuminate those numerals associated with the address of the house.

2. Discussion

Displays are used in a wide variety of applications and are normally adapted to selectively illuminate certain predefined information. For example, displays may be used to indicate building exits, hazardous areas, fire escapes, and provide many other useful types of information. One application of display devices is to selectively illuminate those numerals associated with a home address.

One such prior display is described and claimed within U.S. Pat. No. 4,969,282 ("the '282 patent"), filed on Dec. 2, 1988, entitled "Glass Block Illuminated Display", and fully incorporated herein by reference. While the display assembly described in the '282 patent does provide selective numeral illumination, by the use of neon tubes which are placed within a hollow glass block, it has been found to be relatively costly, difficult to manufacture, and rather heavy and bulky. In fact, these same drawbacks are also associated with many of the other types of selective illumination display devices, which are known in the prior art.

There is therefore a need to provide a display which is adapted to selectively illuminate information, and which is further adapted to be relatively easily manufactured, of low cost, and which is further relatively easily maintained and relatively lightweight.

SUMMARY OF THE INVENTION

It is an object of this invention to provide a display assembly which is adapted to selectively illuminate information.

It is a further object of this invention to provide a display assembly which is adapted to selectively illuminate those numerals which are associated with a home address.

It is yet a further object of this invention to provide a display assembly which is adapted to be mounted upon a house and which is further adapted to selectively illuminate those numerals associated with the address of the house.

It is yet a further object of this invention to provide a display assembly which is adapted to selectively illuminate numerals associated with a house address, and which is further adapted to be relatively easy to manufacture, of low cost, lightweight, and relatively easily maintained.

According to one aspect of this invention, a display assembly is provided. More particularly, this display assembly includes a hollow rectangular mounting member having a generally flat edge portions and generally rectangular flanges which are each adapted to receive a fastener, the fasteners being adapted to cooperatively mount the mounting member to a mounting surface; a flat panel having a first surface adapted to be mounted to the generally flat edge portion; a tubular neon display of a predetermined and certain configuration, the neon display being mounted upon a second surface of the flat panel opposite the first surface; transformer means, mounted upon the first surface and adapted to be coupled to a source of electrical power and to said tubular neon display for energizing the display thereby causing the display to illuminate; and sensor means, coupled to the transformer means, for selectively preventing the tubular neon display from becoming energized by the transformer means.

Further objects, features, and advantages of the invention will become apparent from a consideration of the following description and claims, when taken in conjunction with the accompanying drawings.

BRIEF DESCRIPTION OF THE DRAWINGS

Various advantages of the present invention will become apparent to those skilled in the art by reading the following specification and by reference to the following drawings in which:

FIG. 1 is a partial perspective view of the display assembly made in accordance with the teachings of the preferred embodiment of this invention;

FIG. 2 is a partial perspective and unassembled view of the display assembly shown in FIG. 1; and FIG. 3 is a portion of the display assembly shown in FIG. 1 and taken along view line 3—3.

DETAILED DESCRIPTION OF THE INVENTION

Referring now to FIGS. 1–3, there is shown a display assembly 10 made in accordance with the teachings of the preferred embodiment of this invention. As shown, assembly 10 includes a hollow rectangular mounting member 12, made of plastic and having a wide mouth area, including generally flat edged portions 14, and a narrow flat bottom portion 16. Moreover, member 12 further includes generally rectangular flanges 18, 20 which are adapted to receive typical fasteners 22 and which cooperatively mount assembly 10 upon a surface 24, such as a house.

Assembly 10 further includes a flat plate 26, made of plastic and having a top surface 28, upon which neon tubes 30 are mounted. As shown, tubes 30 are configured in a pre-determined and certain shape which is substantially identical to the numerals associated with the address of a particular house. Moreover, flat plate 26 further includes a back surface 32 upon which a transformer 34 is mounted. As should be known to anyone in the skill of the art, transformer 34 is electrically coupled to neon tubes 30 and to a source of electrical power 36. In this manner, power source 36 cooperates with transformer 34 to energize tubes 30, thereby allowing the numerals associated with the house address to be illuminated. Moreover, since both members 12 and 26 are made of plastic, no electrical grounding apparatus is required.

In the preferred embodiment of this invention, assembly 10 further includes a typical light sensor 40 which is partially contained in the cavity formed by plate 26 and member 12, and which is electrically coupled to power source 36 and transformer 34. As should be known to those of ordinary skill in the art, light sensor 40 is adapted to selectively prevent electrical power generated from source 36 to be applied to transformer 34 during the daylight. In this manner, tubes 30 are prevented from being illuminated. During darkness, sensor 40 allows electrical power to be coupled from source 36 to transformer 34, thereby allowing tubes 30 to be illuminated. Moreover, as shown best in FIG. 30, plate 26 may be removably coupled to flat edges 14 by typical fastening means or glue beads 42.

It should be apparent to one of ordinary skill in the art, that the display illumination assembly 10 is lightweight, relatively easy to manufacture, is relatively easy to maintain and is rather low in cost, thereby overcoming many of the drawbacks of the prior art of the prior display devices known to those of ordinary skill in the art. Therefore, it is understood that the invention is not limited to the exact construction or method illustrated and described above, but the various changes and modifications may be made without departing from the spirit and scope of the invention, as defined in the following claims.

I claim:

1. A display assembly comprising:

a hollow rectangular mounting member having a wide open mouth and a flat bottom which is narrower than said mouth and of a certain size and shape and further having a flat edge portion which is of the same shape as said flat bottom and which is recessed within said mounting member between said wide open mouth and said flat bottom;

a flat panel having a first surface mounted upon said flat edge portion;

a tubular neon display of a certain and predetermined configuration, said display being mounted upon a second surface of said flat panel opposite said first surface and completely recessed within said wide open mouth;

transformer means mounted upon said first surface and coupled to a source of electrical power and to said tubular neon display for energizing said display, thereby causing said display to illuminate; and sensor means, coupled to said transformer means, for selectively preventing said tubular neon display from becoming energized by said transformer means.

2. The display of claim 1, wherein said certain and predetermined configuration comprises a series of numbers.

3. The display of claim 1, wherein said sensor means comprises a light sensor.

4. The display of claim 1, wherein said assembly further comprising rectangular flange means, coupled to said mounting member, for mounting said display assembly to a surface.

* * * * *